US010662959B2

(12) United States Patent
Abrol et al.

(10) Patent No.: US 10,662,959 B2
(45) Date of Patent: May 26, 2020

(54) SYSTEMS AND METHODS FOR COMPRESSOR ANOMALY PREDICTION

(71) Applicant: General Electric Company, Schenectady, NY (US)

(72) Inventors: Sidharth Abrol, Bangalore (IN); Karl Dean Minto, Greenville, SC (US); Nisam Palakkavalappil Rahiman, Bangalore (IN); Prabhanjana Kalya, Hyderabad (IN); Wrichik Basu, Manchester (GB); Corey Nicholas Bufi, Troy, NY (US)

(73) Assignee: General Electric Company, Schenectady, NY (US)

( * ) Notice: Subject to any disclaimer, the term of this patent is extended or adjusted under 35 U.S.C. 154(b) by 453 days.

(21) Appl. No.: 15/473,776

(22) Filed: Mar. 30, 2017

(65) Prior Publication Data

US 2018/0283391 A1 Oct. 4, 2018

(51) Int. Cl.
*F04D 27/00* (2006.01)
*F04D 19/02* (2006.01)
(Continued)

(52) U.S. Cl.
CPC ..... *F04D 27/001* (2013.01); *F01D 21/14* (2013.01); *F04D 19/02* (2013.01);
(Continued)

(58) Field of Classification Search
CPC ..... F04D 27/001; F04D 19/02; F04D 29/522; F04D 29/324; F04D 27/0246;
(Continued)

(56) References Cited

U.S. PATENT DOCUMENTS 3,852,958 A 12/1974 Adams et al.
3,867,717 A 2/1975 Moehring et al.
(Continued)

FOREIGN PATENT DOCUMENTS

EP 1860282 11/2007
EP 3 103 968 A1 12/2016
(Continued)

OTHER PUBLICATIONS

Yinhe Cao, et. al., "Detecting dynamical changes in time series using the permutation entropy," Physical Review E 70, 046217 (2004). (Year: 2004).*

(Continued)

*Primary Examiner* — Alexander Satanovsky
*Assistant Examiner* — Mark I Crohn
(74) *Attorney, Agent, or Firm* — Fletcher Yoder, P.C.

(57) ABSTRACT

A non-transitory computer-readable storage medium storing one or more processor-executable instructions wherein the one or more instructions, when executed by a processor of a controller, cause acts to be performed including receiving signals representative of pressure between respective compressor blade tips and a casing of a compressor at one or more stages, generating multiple patterns based on a permutation entropy window and the signals, identifying multiple pattern categories in the multiple patterns, determining a permutation entropy based on the multiple patterns and the multiple pattern categories, predicting an anomaly in the compressor based on the permutation entropy, comparing the multiple pattern categories to determined permutations of pattern categories when an anomaly is present in the compressor, and predicting a category of the anomaly based on the comparison of the multiple pattern categories to the determined permutation of pattern categories.

20 Claims, 9 Drawing Sheets

(51) Int. Cl.

| | |
|---|---|
| ***F04D 29/32*** | (2006.01) |
| ***F04D 29/52*** | (2006.01) |
| ***F01D 21/14*** | (2006.01) |
| ***F04D 27/02*** | (2006.01) |

(52) U.S. Cl.
CPC ..... *F04D 27/0246* (2013.01); *F04D 29/324* (2013.01); *F04D 29/522* (2013.01); *F05D 2260/82* (2013.01); *F05D 2270/101* (2013.01); *F05D 2270/301* (2013.01)

(58) Field of Classification Search
CPC ..... F01D 21/14; F01D 1/00; F05D 2270/301; F05D 2270/101; F05D 2260/82
See application file for complete search history.

(56) References Cited

U.S. PATENT DOCUMENTS

| | | | | |
|---|---|---|---|---|
| 4,117,668 | A | 10/1978 | Elsaesser et al. | |
| 4,137,710 | A | 2/1979 | Preti et al. | |
| 4,216,672 | A | 8/1980 | Henry et al. | |
| 5,051,918 | A | 9/1991 | Parsons | |
| 5,448,881 | A | 9/1995 | Patterson et al. | |
| 5,782,603 | A | 7/1998 | O'Brien et al. | |
| 6,098,010 | A | 8/2000 | Krener et al. | |
| 6,438,484 | B1 | 8/2002 | Andrew et al. | |
| 6,474,935 | B1 | 11/2002 | Crotty et al. | |
| 6,506,010 | B1 | 1/2003 | Yeung et al. | |
| 6,532,433 | B2 | 3/2003 | Bharadwaj et al. | |
| 6,536,284 | B2 | 3/2003 | Bonanni | |
| 7,003,426 | B2 | 2/2006 | Bonanni et al. | |
| 7,596,953 | B2 | 10/2009 | Krok et al. | |
| 8,342,794 | B2 | 1/2013 | Staroselsky et al. | |
| 8,955,372 | B2 | 2/2015 | Repetto et al. | |
| 9,200,572 | B2 | 12/2015 | Hoang | |
| 9,792,551 | B1 * | 10/2017 | Lu | G06N 5/045 |
| 2003/0007860 | A1 | 1/2003 | Nakajima et al. | |
| 2009/0312930 | A1 * | 12/2009 | Nakakita | F01D 17/08 701/100 |
| 2012/0328410 | A1 | 12/2012 | Narayanan et al. | |
| 2013/0276425 | A1 | 10/2013 | Rittenhouse | |
| 2016/0123175 | A1 | 5/2016 | Mazzaro | |
| 2019/0032510 | A1 * | 1/2019 | Abrol | F23R 3/46 |

FOREIGN PATENT DOCUMENTS

| | | |
|---|---|---|
| JP | 11101196 | 4/1999 |
| KR | 20050057775 | 6/2005 |
| KR | 20050057777 | 6/2005 |

OTHER PUBLICATIONS

Extended European Search Report and Opinion issued in connection with corresponding EP Application No. 18157210.8 dated Aug. 30, 2018.

* cited by examiner

SYSTEMS AND METHODS FOR COMPRESSOR ANOMALY PREDICTION

BACKGROUND

The subject matter disclosed herein relates to a compressor of a gas turbine system and, more particularly, to systems and methods for compressor anomaly prediction.

Gas turbine systems generally include a compressor, a combustor, and a turbine. The compressor compresses air from an air intake, and subsequently directs the compressed air to the combustor. The combustor combusts a mixture of the compressed air and fuel to produce hot combustion gases then directed to the turbine to produce work, such as to drive an electrical generator or other load. However, components of the gas turbine system may experience wear and tear during use and/or operating conditions of the gas turbine system may change, thus leading to anomalies such as stall, surge, and/or instabilities in the compressor. The anomalies may go unrecognized, resulting in decreased efficiency, reduced maintenance intervals, and damage to components. Therefore, stall, surge, instabilities, or other anomalies in the compressor are costly and labor-intensive occurrences.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In a first embodiment, a non-transitory computer-readable storage medium storing one or more processor-executable instructions wherein the one or more instructions, when executed by a processor of a controller, cause acts to be performed including receiving one or more signals representative of pressure between respective compressor blade tips and a casing of a compressor at one or more stages. The acts include generating multiple patterns based on a permutation entropy window and the signals, and identifying multiple pattern categories in the multiple patterns. Additionally, the acts include determining a permutation entropy based on the multiple patterns and the multiple pattern categories, and predicting an anomaly in the compressor based on the permutation entropy. Further, the acts include comparing the multiple pattern categories to determined permutations of pattern categories when an anomaly is present in the compressor. Also, the acts further include predicting a category of the anomaly based on the comparison of the multiple pattern categories to the determined permutation of pattern categories.

In a second embodiment, a system for predicting an anomaly in a compressor includes one or more sensors disposed on a casing of the compressor adjacent respective compressor blade tips at one or more stages. The one or more sensors are configured to generate sensor-signals representative of pressure between respective compressor blade tips and the casing of the compressor at the one or more stages. The system also includes a controller operatively coupled to the one or more sensors and programmed to pre-process the sensor-signals to generate pre-processed signals. The controller is also programmed to generate multiple patterns based on a permutation entropy window and the pre-processed signals, and to identify multiple pattern categories in the multiple patterns. Additionally, the controller is also programmed to determine a permutation entropy based on the multiple patterns and the multiple pattern categories, and to predict an anomaly in the compressor based on the permutation entropy. Further, the controller is programmed to compare the multiple pattern categories to determined permutations of pattern categories when an anomaly is present in the compressor. Also, the controller is further programmed to predict a category of the anomaly based on the comparison of the multiple pattern categories to the determined permutation of pattern categories.

In a third embodiment, a system, includes a gas turbine including a compressor. The compressor includes multiple stages, each stage having multiple compressor blades. The system includes one or more sensors disposed on a casing of the compressor adjacent respective compressor blade tips at one or more stages of the multiple stages. The one or more sensors are configured to generate sensor-signals representative of pressure between respective compressor blade tips and the casing of the compressor at the one or more stages. The system further includes a controller operatively coupled to the one or more sensors and programmed to pre-process the sensor-signals to generate pre-processed signals. The controller is also programmed to generate multiple patterns based on a permutation entropy window and the pre-processed signals, and to identify multiple pattern categories in the multiple patterns. Additionally, the controller is also programmed to determine a permutation entropy based on the multiple patterns and the multiple pattern categories, and to predict an anomaly in the compressor based on the permutation entropy. Further, the controller is programmed to compare the multiple pattern categories to determined permutations of pattern categories when an anomaly is present in the compressor. Also, the controller is further programmed to predict a category of the anomaly based on the comparison of the multiple pattern categories to the determined permutation of pattern categories.

BRIEF DESCRIPTION OF THE DRAWINGS

These and other features, aspects, and advantages of the present subject matter will become better understood when the following detailed description is read with reference to the accompanying drawings in which like characters represent like parts throughout the drawings, wherein.

DETAILED DESCRIPTION

One or more specific embodiments of the present subject matter will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present subject matter, the articles "a," "an," "the," and "said" are intended to mean that there are one or more of the elements. The terms "comprising," "including," and "having" are intended to be inclusive and mean that there may be additional elements other than the listed elements.

The disclosed embodiments include systems and methods for predicting an anomaly in a compressor of a gas turbine system. When an anomaly is predicted, the embodiments further include causing the gas turbine system to perform a corrective action to minimize or avoid the predicted anomaly. As described above, some examples of an anomaly in a compressor include a stall, a surge, an instability in the compressor, or a combination thereof. The embodiments include utilizing pressure sensors that generate high speed time-series sensor-signals representative of pressure (e.g., aerodynamic pressure) between respective compressor blade tips and a casing of the compressor, then transmitting the sensor-signals to a service platform including a pattern recognition algorithm. The embodiments further include determining a permutation entropy for the high speed time-series sensor-signals to quickly predict the anomaly. A measure of the anomaly is then calculated based on a threshold determined from operating conditions of the gas turbine system, a probability distribution of the permutation entropy, historical permutation entropy data, or the like. Accordingly, control actions may be taken to minimize or avoid a predicted anomaly of the compressor. The disclosed embodiments may accordingly reduce the quantity or severity of anomalies of the compressor, thus increasing a lifetime and increasing an efficiency of the compressor and its corresponding gas turbine system.

Figure 1:
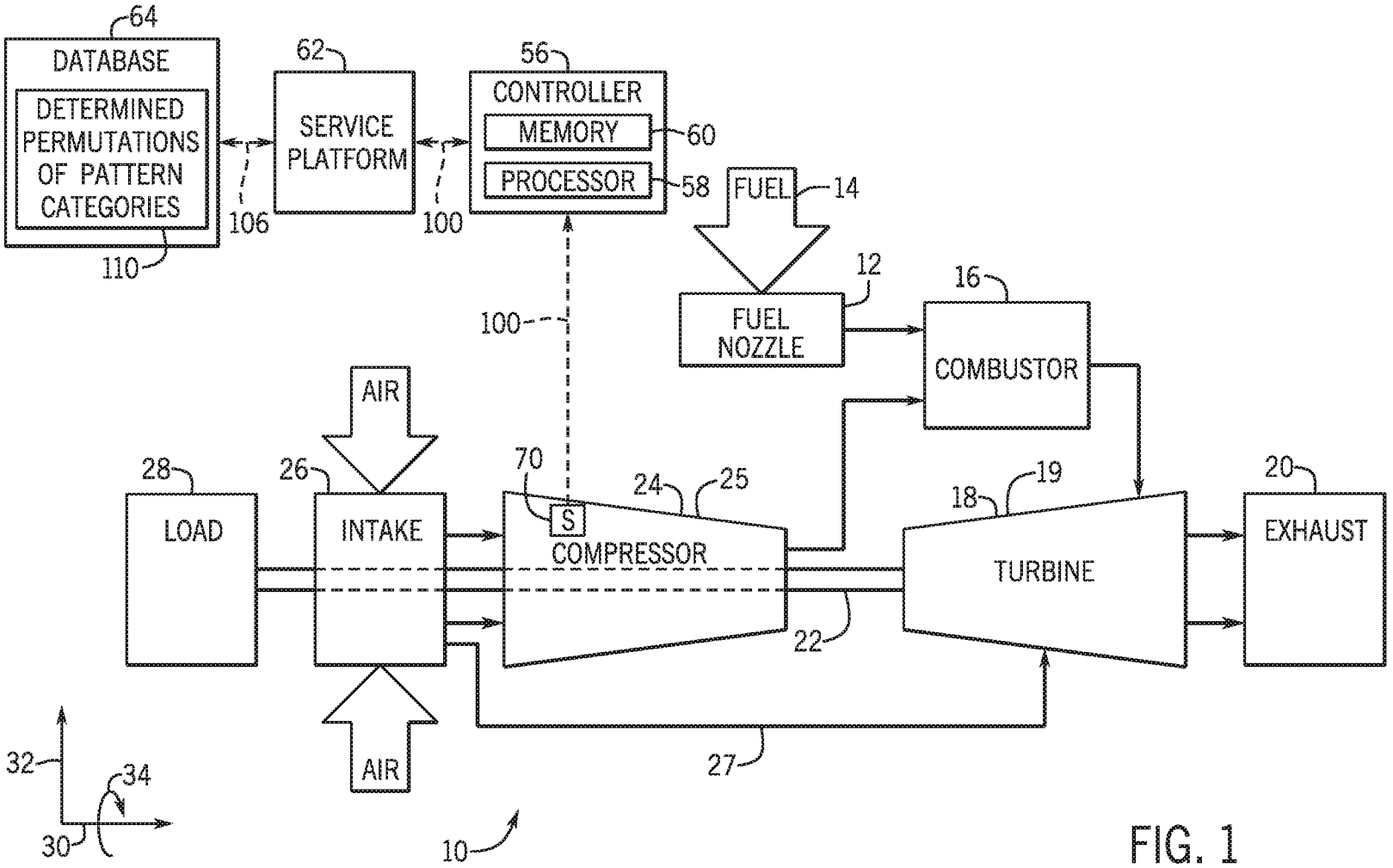
FIG. 1 is a schematic diagram of an embodiment of a gas turbine system having a service platform for predicting anomalies in a compressor.

Turning to the drawings, FIG. 1 is a block diagram of an embodiment of a gas turbine system 10 for predicting an anomaly in a compressor 24. As described in detail below, the disclosed gas turbine system 10 (e.g., turbine system, gas turbine) may employ a service platform 62 to predict anomalies (e.g., stall, surge, instability) in the compressor 24. As noted above, the gas turbine system 10 may take control actions to minimize or avoid the anomalies.

To generate power, the gas turbine system 10 may use liquid or gas fuel, such as natural gas and/or a hydrogen rich synthetic gas, to drive the gas turbine system 10. As depicted, fuel nozzles 12 intake a fuel supply 14, mix the fuel with an oxidant, such as air, oxygen, oxygen-enriched air, oxygen reduced air, or any combination thereof. Although the following discussion refers to the oxidant as the air, any suitable oxidant may be used with the disclosed embodiments. Once the fuel and air have been mixed, the fuel nozzles 12 distribute the fuel-air mixture into a combustor 16 in a suitable ratio for optimal combustion, emissions, fuel consumption, and power output. The gas turbine system 10 may include one or more fuel nozzles 12 located inside one or more combustors 16. The fuel-air mixture combusts in a chamber within the combustor 16, thereby creating hot pressurized exhaust gases. The combustor 16 directs the exhaust gases (e.g., hot pressurized gas) through a transition piece into a turbine nozzle (or "stage one nozzle"), and other stages of buckets (or blades) and nozzles causing rotation of a turbine 18 within a turbine casing 19 (e.g., outer casing). The exhaust gases flow toward an exhaust outlet 20. As the exhaust gases pass through the turbine 18, the gases force turbine buckets (or blades) to rotate a shaft 22 along an axis of the gas turbine system 10.

As illustrated, the shaft 22 may be connected to various components of the gas turbine system 10, including the compressor 24. The compressor 24 also includes blades coupled to the shaft 22, as described in more detail with reference to FIG. 2. As the shaft 22 rotates, the blades within the compressor 24 also rotate within a compressor casing 25 (e.g., outer casing), thereby compressing air from an air intake 26 through the compressor 24 and into the fuel nozzles 12 and/or combustor 16. A portion of the compressed air (e.g., discharged air) from the compressor 24 may be diverted to the turbine 18 or its components without passing through the combustor 16, as shown by arrow 27. The discharged air (e.g., cooling fluid) may be utilized to cool turbine components such as shrouds and nozzles on the stator, along with buckets, disks, and spacers on the rotor. The shaft 22 may also be connected to a load 28, which may be a vehicle or a stationary load, such as an electrical generator in a power plant or a propeller on an aircraft, for example. The load 28 may include any suitable device capable of being powered by the rotational output of the gas turbine system 10. The gas turbine system 10 may extend along an axial axis or direction 30, a radial direction 32 toward or away from the axis 30, and a circumferential direction 34 around the axis 30.

The gas turbine system 10 may also include a controller 56 (e.g., an electronic and/or processor-based controller) to govern operation of the gas turbine system 10. The controller 56 may independently control operation of the gas turbine system 10 by electrically communicating with sensors, control valves, and pumps, or other flow adjusting features throughout the gas turbine system 10. The controller 56 may include a distributed control system (DCS) or any computer-based workstation that is fully or partially automated. For example, the controller 56 can be any device employing a general purpose or an application-specific processor 58, both of which may generally include memory 60 (e.g., memory circuitry) for storing instructions. The processor 58 may include one or more processing devices, and the memory 60 may include one or more tangible, non-transitory, machine-readable media collectively storing instructions executable by the processor 58 to control the gas turbine system 10, as described below, and to perform control actions described herein. More specifically, the controller 56 receives input signals from various components of the gas turbine system 10 and outputs control signals to control and communicate with various components in the gas turbine system 10 in order to control the flow rates, motor speeds, valve positions, and emissions, among others, of the gas turbine system 10. The controller 56 may communicate with control elements of the gas turbine system 10. The controller 56 may adjust combustion parameters, adjust flows of the fluids throughout the system, adjust operation of the gas turbine system 10, and so forth.

As illustrated, the controller 56 is in communication with one or more sensors 70 disposed within the compressor 24. The sensor 70 may collect data related to the compressor 24 and transmit sensor-signals 100 (e.g., voltages) indicative of the data to the controller 56. The sensors 70 may transmit the sensor-signals 100 at high speeds (e.g., 200 kHz, 500 kHz.) For example, the sensor 70 may be coupled to an inner surface of the compressor casing 25 of the compressor 24 to collect data and transmit signals representative of pressure (e.g., aerodynamic pressure) between respective compressor blade tips and the compressor casing 25 at the one or more stages, as described in more detail with reference to FIG. 2 below. The sensor 70 may be considered "proximate" and/or "adjacent" to the set of blades 80 to which it is closest, disposed opposite of, and the like. Additionally, the sensor 70 may be any type of sensor suitable for collecting parameters (e.g., pressure data) of the compressor 24, such as an acoustic sensor, a pressure sensor, a vibration sensor, a piezoelectric sensor, or a combination thereof. In certain embodiments, the sensor 70 may be a different type of sensor and collect a different parameter (e.g., temperature, flowrate) related to the gas turbine system 10.

Although the controller 56 has been described as having the processor 58 and the memory 60, it should be noted that the controller 56 may include a number of other computer system components to enable the controller 56 to control the operations of the gas turbine system 10 and the related components. For example, the controller 56 may include a communication component that enables the controller 56 to communicate with other computing systems. The controller 56 may also include an input/output component that enables the controller 56 to interface with users via a graphical user interface or the like. Additionally, there may be more than one sensor 70 disposed within the compressor 24 of the gas turbine system 10. For example, there may be a sensor 70 coupled to the inner surface of the compressor 24 for one or more stages of the compressor 24. Additionally, it is to be noted that either or both the controller 56 and the service platform 62 may perform or include the embodiments described herein.

As shown in the present embodiment, the controller 56 is coupled to a service platform 62 (e.g., anomaly prediction platform). In certain embodiments, the service platform 62 may be a cloud-based platform, such as a service (PaaS). In certain embodiments, the service platform 62 may perform industrial-scale analytics to analyze performance of and predict anomalies related to both the gas turbine system 10 and each component (e.g. compressor 24) of the gas turbine system 10. As shown, the service platform 62 is communicatively coupled to a database 64. The database 64 and/or the memory 60 may store historical data related to the gas turbine system 10 (e.g., received by the one or more sensors 70), one or more models, and other data. For example, the database 64 and/or the memory 60 may store an algorithm (e.g., a pattern recognition based algorithm) for predicting anomalies of the gas turbine system 10 and the compressor 24, and causing a corrective action to occur to minimize or avoid the predicted anomaly, as described in greater detail below. Additionally, the database 64 may store determined permutations 110 of pattern categories, as described in detail below with reference to FIG. 2 and FIG. 4.

Figure 2:
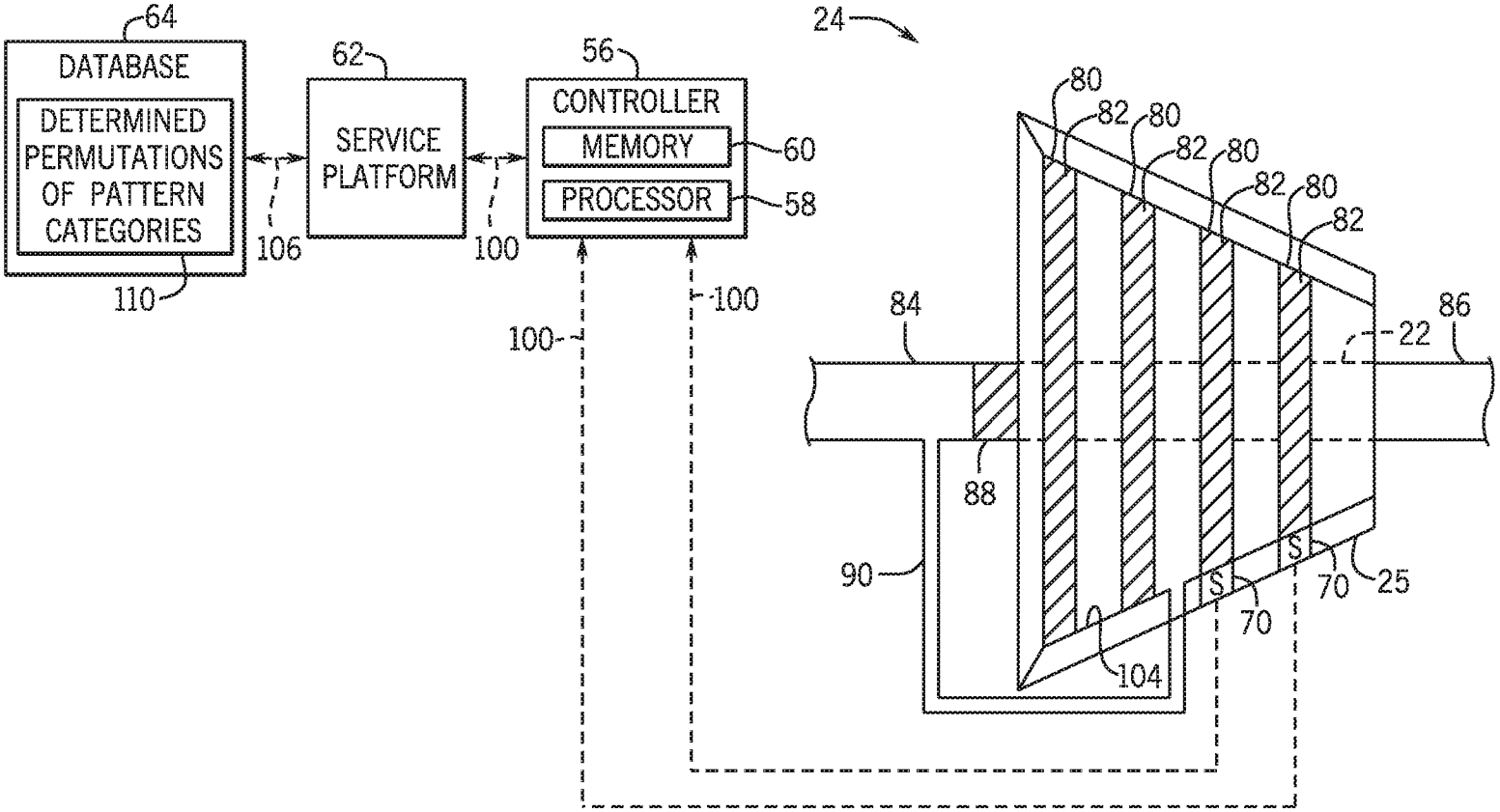
FIG. 2 is a cross-sectional view of an embodiment of a compressor within the gas turbine system of FIG. 1.

Turning now to FIG. 2, the compressor 24 may include several sets of blades 80 that are arranged in stages or rows 82 around the rotor or shaft 22. The compressor 24 is coupled to the air intake 26 via an intake shaft 84 of the shaft 22, and to a combustion system (e.g., the combustor 16 and/or the turbine 18) via an output shaft 86 of the shaft 22. A set of inlet guide vanes 88 controls the amount of fluid (e.g., air) that enters the compressor 24 at any given time. In particular, the angles of the blades of the inlet guide vanes 88 may determine the amount of fluid that enters the compressor 24. When the angles of the blades are relatively small (i.e., "substantially closed") less fluid is received, but when the angles of the blades are relatively large (i.e., "substantially open") more fluid is received. The angles of the blades of the inlet guide vanes 88 may be controlled by the controller 56 as a control action to minimize or avoid a predicted anomaly, as described in further detail below.

During operation, the fluid travels through the compressor 24 and becomes compressed. That is, each set of blades 80 rotatively moves the fluid through the compressor 24 while reducing the volume of the fluid, thereby compressing the fluid. Compressing the fluid generates heat and pressure. In the present embodiments, the compressor 24 may be configured to re-circulate the compressor discharge (e.g., discharge fluid) back into the intake shaft 84 via an inlet manifold 90. The re-circulated compressor discharge fluid is commonly referred to as "inlet bleed heat," and may be adjusted to adjust certain parameters of the compressor 24. Advantageously, the techniques described herein may control the inlet bleed heat as a control action to minimize or avoid a predicted anomaly in the compressor 24, as described in further detail below.

As shown in the present embodiment, two sensors 70 are included in the compressor 24. In certain embodiments, the sensors 70 are disposed on an inner surface 104 of the compressor casing 25 of the compressor 24. The sensors 70 may be disposed on the inner surface 104 opposite of one or more of the sets of blades 80. Moreover, in certain embodiments, a sensor 70 may be disposed within the compressor 24 opposite of each set of blades 80, or opposite of only one set of blades 80. The sensors 70 may include, for example, an acoustic sensor, a pressure sensor, a vibration sensor, a combination thereof, and the like.

The sensors 70 generate sensor-signals 100 representative of parameters (e.g., pressure sensor-signals, signals representative of pressure or aerodynamic pressure between respective compressor blade tips and the compressor casing 25 of the compressor 24 at the one or more stages 82 of the compressor 24) in the compressor 24. As shown, the sensor-signals 100 may be transmitted to the controller 56, which may transmit the sensor-signals 100 to the service platform 62. In embodiments in which the service platform 62 is included in the controller 56, the sensor-signals 100 generated by the sensors 70 may be transmitted directly to the service platform 62.

The service platform 62 may process the sensor-signals 100 to generate pre-processed signals 106. The service platform 62 may generate a pre-processed signal 106 for each sensor-signal 100. The generation of the pre-processed signals 106 will be described in greater detail with reference to FIG. 7 below.

In certain embodiments, the service platform 62 may store the pre-processed signals 106 in the database 64. In embodiments where the sensor-signals 100 are not pre-processed, the service platform 62 may instead store the sensor-signals 100 in the database 64. Additionally, the service platform 62 may retrieve the pre-processed signals 106 from the database 64 for further processing. In certain embodiments, the pre-processed signals 106 are representative of parameters in the compressor 24. For example, each pre-processed signal 106 may be representative of a pressure or aerodynamic pressure between the compressor casing 25 and tips of the set of blades 80 the respective sensor 70 is disposed proximate.

In addition, the service platform 62 may analyze the sensor-signals 100 (e.g., time-series data) for multiple channels of data to provide a robust, multi-variate analysis of the sensor-signals 100 and/or the pre-processed signals 106. For example, the service platform 62 may generate a matrix of the sensor-signal 100 via a vector indicative of each sensor 70 disposed within the compressor 24, and/or a vector indicative of each blade of a set of blades 80 proximate a sensor 70. In this manner, the embodiments disclosed herein may be repeated for each blade and/or stage 82 of the compressor 24 and/or sensor 70 within the compressor 24 to increase the granularity of the sensor-signals 100 and/or the pre-processed signals 106 utilized for anomaly prediction. The multi-variate analysis of the sensor-signals 100 and/or the pre-processed signals 106 will be described in greater detail with reference to FIG. 3.

The service platform 62 may generate a plurality of patterns based on a permutation entropy window and the signal. As used herein, the term "permutation entropy window" is used to refer to a virtual window that is characterized by an embedding dimension (e.g., "D"). Furthermore, the permutation entropy window is used to select a subset of data from a signal such that the subset of the data is characterized by a length equal to the embedding dimension. The embedding dimension, for example, may include a determined number of time stamps or a determined number of samples (e.g., sample count). These elements are described in more detail with reference to FIG. 9 and FIG. 10.

In certain embodiments, the signals may include the sensor-signals 100, the pre-processed signals 106, or a combination thereof. Additionally, the service platform 62 may further identify a plurality of pattern categories in the patterns. The generation of the patterns and the identification of the pattern categories will be described in greater detail with reference to FIGS. 8-10.

In certain embodiments, the service platform 62 may be configured to determine a permutation entropy or a weighted permutation entropy based on the patterns and pattern categories. Furthermore, the service platform 62 may be configured to predict the anomaly in the compressor 24 based on the permutation entropy or the weighted permutation entropy. The determination of the permutation entropy will be described in greater detail with reference to FIG. 11. Also, the determination of the weighted permutation entropy will be described in greater detail with reference to FIG. 12.

In situations where presence of an anomaly in the compressor 24 is predicted by the service platform 62, the service platform 62 is further configured to compare the pattern categories to the determined permutations 110 of pattern categories. The service platform 62, for example, may retrieve the determined permutations 110 of pattern categories from the database 64. In certain embodiments, the determined permutations 110 of pattern categories may be stored in the database 64 by a user before or after commissioning of the gas turbine system 10.

In accordance with aspects of the present disclosure, the service platform 62 may predict a category of the anomaly in the compressor 24 based on the comparison of the pattern categories with the determined permutations 110 of pattern categories. The category of the anomaly in the compressor 24, for example, may include a stall, a surge, an instability in the compressor 24, or a combination thereof 24. Examples of the determined permutations 110 of pattern categories and the comparison of the pattern categories with the determined permutations 110 of pattern categories will be described in greater detail with reference to FIG. 11.

Figure 3:
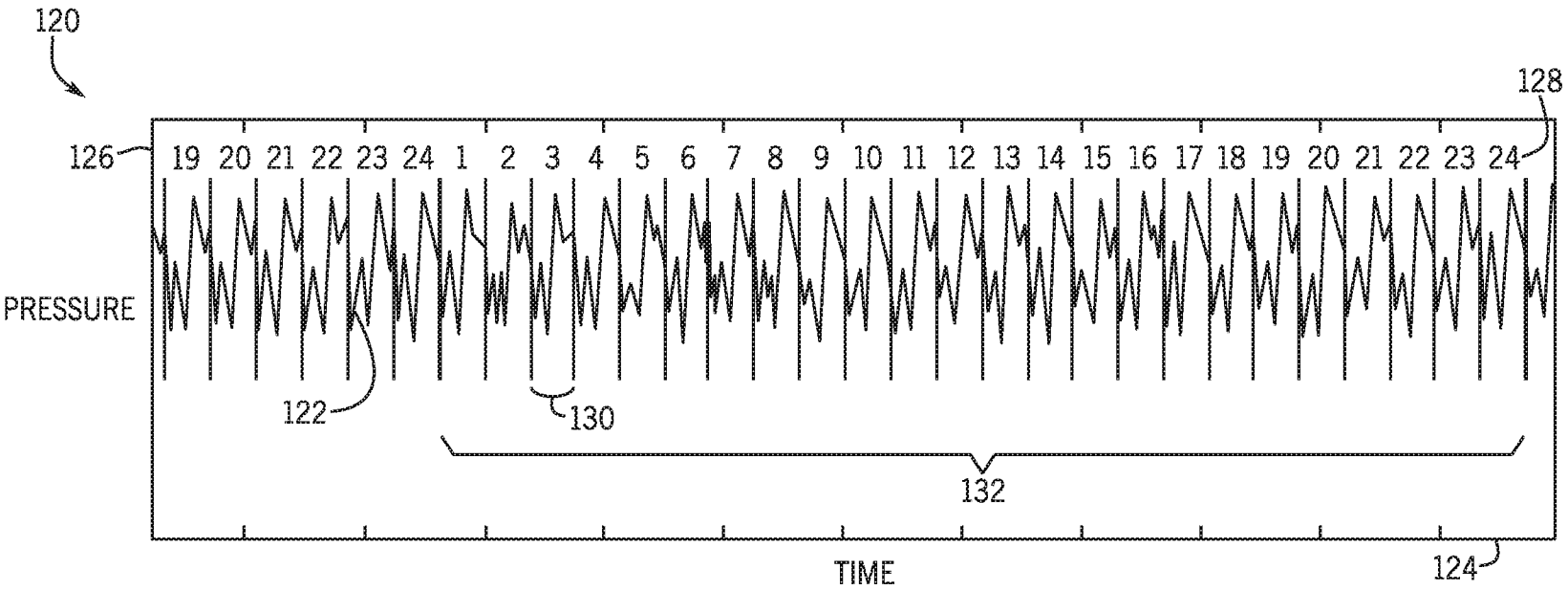
FIG. 3 is a graphical representation of an embodiment of a signal for multi-variate analysis of parameters the compressor of FIG. 1.

FIG. 3 is a graphical representation 120 of an example of a portion of a signal 122 representative for multi-variate analysis of parameters in a compressor. The signal 122 is shown for purposes of illustration. Other signals representative of parameters of compressors may also be used. For example, the signal 122 is representative of pressure in the compressor 24. Reference numeral 124 (first X-axis) is representative of a time stamp. Also, reference numeral 126 (Y-axis) is representative of the pressure in the compressor 24. Moreover, reference numeral 128 is representative of a blade index of the set of blades 80 in the compressor 24 of which the sensor 70 may be disposed proximate. The pre-processing of the sensor-signal 100 may further include identifying a portion 130 of the signal 122 which is indicative of an individual blade of the set of blades 80 in the compressor 24. For example, the individual blade may be identified via the service platform 62 by identifying a revolution 132 of the set of blades 80. The revolution 132 may be identified via an interval of time that corresponds to a known parameter (e.g., rotation rate) of the compressor 24. For example, if the set of blades 80 includes twenty-four blades, and a revolution 132 of the set of blades requires 3 seconds, then each 3 second interval of the signal 122 may be divided into twenty-four portions 130 that each correspond to an individual blade index. In this manner, the signal 122 for the time interval 132 may be divided by the number of blades to generate a number of signals equal to the number of blades.

By generating a number of signals equal to the number of blades in a respective set of blades 80, the service platform 62 may analyze multiple channels of a multi-channel system simultaneously to minimize cross-channel correlation or variance via multi-variate analysis. The multi-variate analysis therefore increases the efficiency and reliability of the service platform. Further, multiple signals 122 from multiple sets of blades 80 may be analyzed in a multi-variate manner to increase the robustness of the service platform 62.

Figure 4:
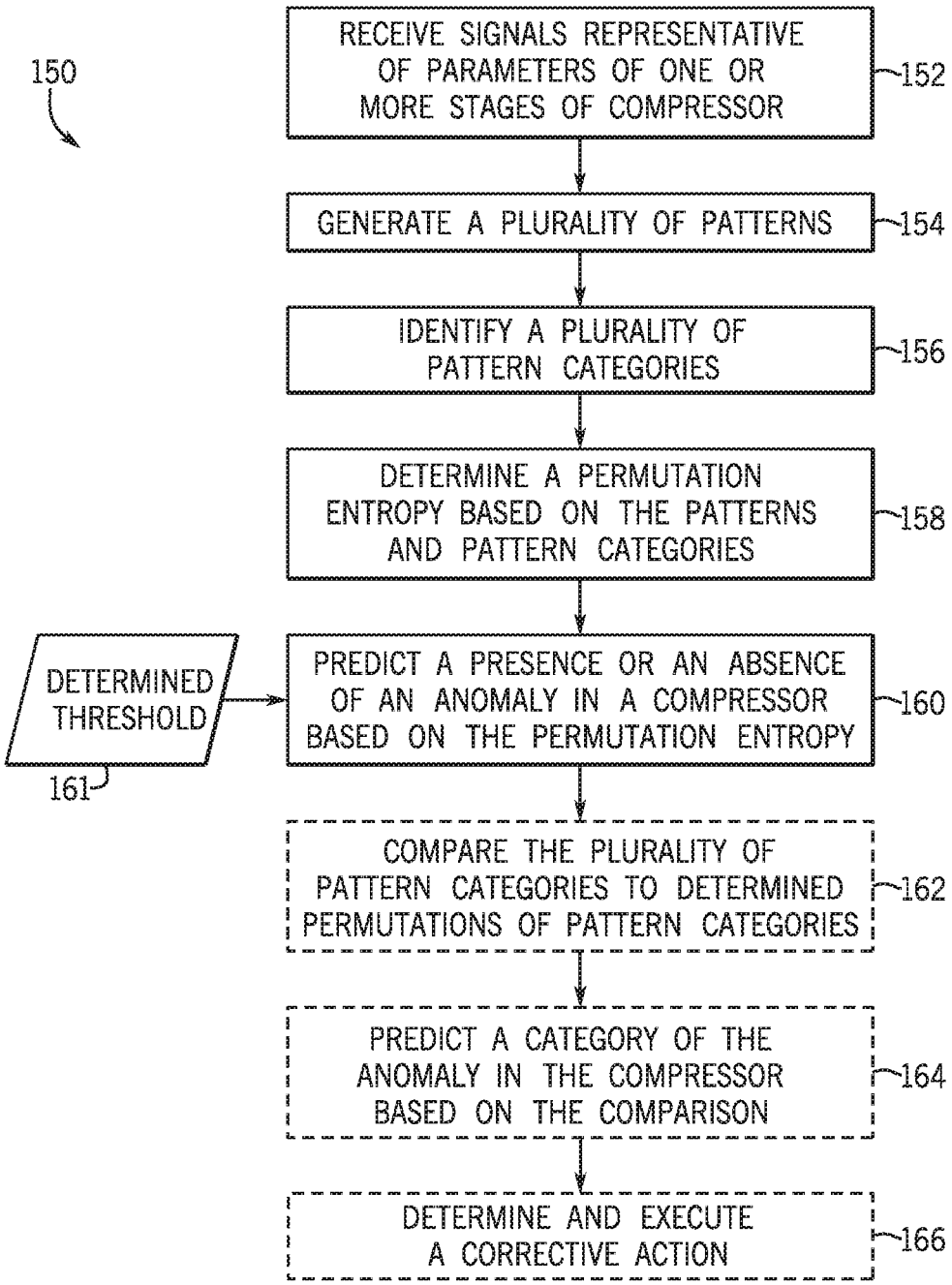
FIG. 4 is a flow diagram of an embodiment of a method for predicting an anomaly in the compressor of FIG. 1.

FIG. 4 is a flow diagram of an embodiment of method 150 for predicting an anomaly in the compressor 24 of the gas turbine system 10 of FIG. 1. Some examples of the anomaly include, but are not limited to, a stall, a surge, an instability in the compressor 24, a combination thereof, and the like. As previously noted, the compressor 24 may include a sensor 70 for one or more set of blades 80 (e.g., stages 82). Accordingly, in one embodiment, the method 150 may be separately executed for each sensor 70 in the compressor 24. Additionally, the method 150 may be separately executed for each blade of the sets of blades 80. The method 150 of FIG.

4 is described with reference to the elements of FIGS. 1-3. The method 150 may be performed by the controller 56 and/or the service platform 62. Additionally, one or more steps of the method 150 may be performed simultaneously or in a different sequence from the sequence in FIG. 4.

The method 150 includes receiving signals representative of parameters of one or more stages 82 of the compressor 24 (block 152). In certain embodiments, the signals may be sensor-signals, pre-processed signals, or a combination thereof. Also, the parameters may include a pressure, a dynamic pressure, a temperature, a vibration, an acoustic wave, a combination thereof, and the like.

In one example, the signals may be sensor-signals 100 generated by the sensors 70 that are disposed on an inner surface 104 of the compressor casing 25 of the compressor 24. Furthermore, the sensor-signals 100 may be received by the service platform 62 and/or by the controller 56. Moreover, in another example, the signals are pre-processed signals 106. The pre-processed signals 106 are generated by processing the sensor-signals 100. In this example, the pre-processed signals 106 may be received by the service platform 62 from the database 64. Generation of the pre-processed signals 106 based on the sensor-signals 100 will be described in greater detail with reference to FIG. 7.

The method 150 also includes generating a plurality of patterns based on a permutation entropy window and the signals (block 154). Generation of the patterns will be described in greater detail with reference to FIG. 9 and FIG. 10. The method 150 further includes identifying a plurality of pattern categories in the patterns (block 156). Identification of the pattern categories in the patterns will be described in greater detail with reference to FIGS. 8-10.

The method 150 further includes determining a permutation entropy based on the patterns and pattern categories (block 158). In certain embodiments, the permutation entropy may be a weighted permutation entropy. Determination of the permutation entropy will be described in greater detail with reference to FIG. 11. Also, determination of the weighted permutation entropy will be described in greater detail with reference to FIG. 12.

The method 150 additionally includes predicting a presence or absence of the anomaly in the compressor based on the permutation entropy or the weighted permutation entropy (block 160). Particularly, presence of any anomaly in the compressor may be predicted based on the permutation entropy and a determined threshold 161. For example, in certain embodiments, a stable permutation entropy is representative of a compressor 24 without an anomaly, while an increasing or variable permutation entropy is representative of a compressor with an anomaly or a predicted anomaly. As used herein, the term "determined threshold" is a numerical value that may be used to determine a presence or an absence of an anomaly in a combustor. The determined threshold 161, for example, may be a function of operating conditions of a gas turbine that includes the compressor, such as a compressor inlet temperature, an inlet guide vane position, inlet bleed heat, and the like. Additionally, the determined threshold 161 may be based on a probability distribution of the permutation entropy defined by a mean and standard deviation of an expected range of the permutation entropy, which varies for varying operating conditions and anomalies. Then, the defined threshold 161 may be based on a specified probability threshold of the probability distribution (e.g., not to exceed 50% probable, 70% probable, 90% probable). Further, the determined threshold may be based on an average of a predefined number of historical permutation entropy values stored in the database 64 and/or memory 60. The permutation entropy may be compared with the determined threshold 161 to predict the presence of an anomaly in the compressor 24. For example, if a current permutation entropy value is greater than the determined threshold 161, the current permutation entropy value will be predicted as an anomaly. For ease of understanding, two examples of predicted anomalies followed by actual anomalies are described in detail with reference to FIG. 5 and FIG. 6.

The method 150 even further includes, if the presence of the anomaly is predicted, comparing the pattern categories identified at step 156 to determined permutations of pattern categories (block 162). The determined permutations of pattern categories may be the determined permutations 110 of pattern categories of FIG. 1 and FIG. 2.

Furthermore, the method 150 includes predicting a category of the anomaly based on the comparison of the pattern categories to the determined permutations 110 of the pattern categories (block 164). As previously noted, the category of the anomaly may include, for example, a stall, a surge, an instability in the compressor 24, a combination thereof, and the like. For ease of understanding, an example of the determination of determined permutations and the category of the anomaly is described herein.

For example, a first determined permutation of pattern categories may include pattern categories such as (1, 2, 3), (1, 3, 2) and (2, 1, 3). It may be noted that the first permutation of pattern categories does not include pattern categories, such as (2, 3, 1), (3, 1, 2) and (3, 2, 1). A presence of each of the pattern categories including (1, 2, 3), (1, 3, 2), (2, 1, 3) and an absence of the pattern categories (2, 3, 1), (3, 1, 2) and (3, 2, 1) may be indicative a presence of a stall anomaly in the combustor.

Furthermore, a second determined permutation of pattern categories may include pattern categories such as (1, 2, 3) and (1, 3, 2). It may also be noted that the second permutation of pattern categories does not include the pattern categories (2, 1, 3), (2, 3, 1), (3, 1, 2) and (3, 2, 1). Presence of the pattern categories including (1, 2, 3) and (1, 3, 2) and an absence of the pattern categories (2, 1, 3), (2, 3, 1), (3, 1, 2) and (3, 2, 1) may be indicative of a presence of a surge anomaly in the combustor.

Additionally, a third determined permutation of pattern categories may include pattern categories such as (2, 3, 1), (3, 1, 2) and (3, 2, 1). However, the third permutation of pattern categories does not include the pattern categories (1, 2, 3), (1, 3, 2), and (2, 1, 3). A presence of the pattern categories including (2, 3, 1), (3, 1, 2) and, (3, 2, 1), and an absence of the pattern categories (1, 2, 3), (1, 3, 2), and (2, 1, 3) may be indicative of presence of other anomalies, such as instabilities, in the compressor.

Further, the method 150 additionally includes determining and executing a corrective action to minimize or avoid the predicted anomaly (block 166). The corrective action, for example, may include altering the inlet guide vane position, altering the inlet bleed heat flow rate, and the like. The controller 56 may close a control loop including the anomaly via the control action to stabilize the gas turbine system 10. In certain embodiments, the controller may operate via feedforward control to minimize or avoid the predicted anomaly. In multi-variate analysis, the control action and determined threshold may be based on a first channel to exceed the determined threshold to provide an even faster response time. It may be noted that in certain embodiments, blocks 162 to 166 may be representative of optional steps in the method 150. It may be noted that blocks 162 to 166 may be executed if the presence of an anomaly in the compressor is predicted at step 160. However, at step 160, if an absence of an anomaly in the combustor is predicted, blocks 162 to 166 may not be executed. In certain embodiments, if a presence or an absence of the anomaly is predicted in the compressor, then a user may be notified about the same.

Figure 5:
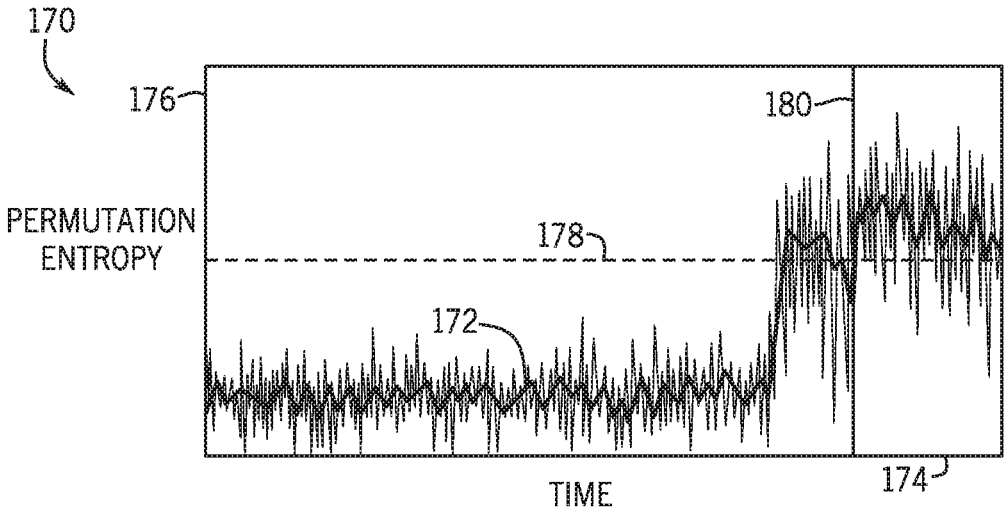
FIG. 5 is a first graphical representation of an embodiment of a first signal used to predict anomalies via the method of FIG. 4.

As previously noted with reference to the step 160, in certain embodiments, the presence or absence of an anomaly in the compressor is based on the permutation entropy and the determined threshold 161. Referring now to FIG. 5, a first graphical representation 170 of an example of a portion of a first signal 172 is shown. In the example of FIG. 5, the signal 172 is shown for purposes of illustration. Other signals representative of parameters in compressors may also be used. In FIG. 5, the signal 172, is representative of permutation entropy in the compressor 24. Reference numeral 174 (X-axis) is representative of a time stamp. Also, reference numeral 176 (Y-axis) is representative of the permutation entropy in the compressor 24.

As shown, a first determined threshold 178 is shown on graphical representation 170. Additionally, a first anomaly 180 is shown on graphical representations 170. The determined threshold 178 may be used to predict when the permutation entropy of the signal 172 is indicative of an anomaly in the compressor 24. The determined threshold 178 may be the determined threshold 161. For example, when the first signal 172 crosses the first determined threshold 178, the first anomaly 180 occurs a short time later.

Figure 6:
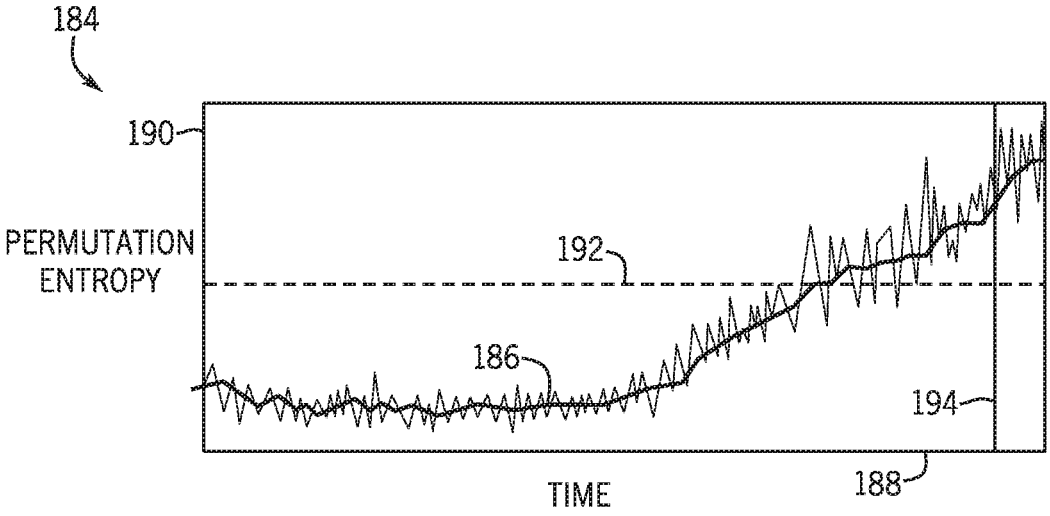
FIG. 6 is a second graphical representation of an embodiment of a second signal used to predict anomalies via the method of FIG. 4.

Referring now to FIG. 6, a second graphical representation 184 of an example of a second signal 186 is shown. In the example of FIG. 6, the signal 186 is shown for purposes of illustration. Other signals representative of parameters in compressors may also be used. In FIG. 6, the signal 186 is representative of permutation entropy in the compressor 24. Reference numerals 188 (X-axis) is representative of a time stamp. Also, reference numeral 190 (Y-axis) is representative of the permutation entropy in the compressor 24.

As shown, a second determined threshold 192 is shown on graphical representation 184. Additionally, a second anomaly 194 is shown on graphical representation 184. The determined thresholds 192 may be used to predict when the permutation entropy of the signal 186 is indicative of an anomaly in the compressor 24. The determined threshold 192 may be the determined threshold 161. For example, when the second signal 186 crosses the second determined threshold 192, the second anomaly 194 occurs a short time later.

By recognizing and predicting a future anomaly, as shown by FIG. 5 and FIG. 6, control actions may be taken by the controller 56 and/or by the service platform 62 to avoid or minimize the anomaly to reduce the quantity or severity of anomalies of the compressor 24, thus increasing a lifetime and increasing an efficiency of the compressor 24 and the gas turbine system 10.

Figure 7:
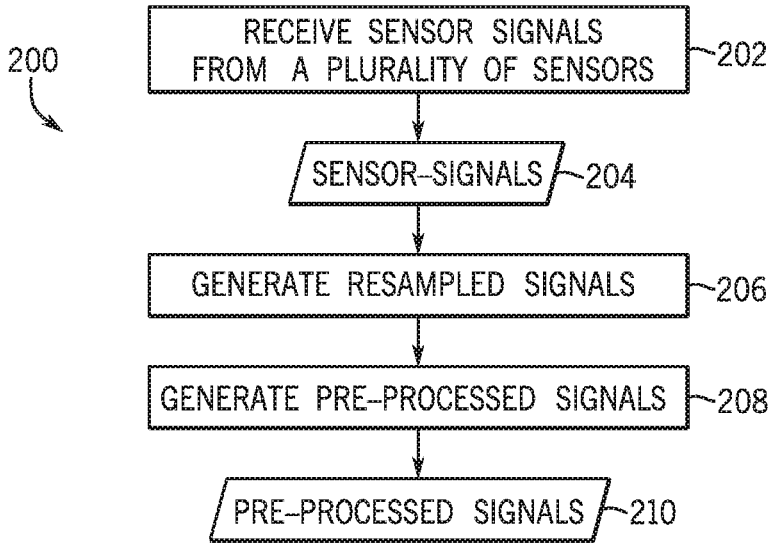
FIG. 7 is a flow diagram of an embodiment of a method for generating pre-processed signals based on sensor-signals utilized to predict an anomaly via the method of FIG. 4.

As previously noted with reference to the step 152, in some embodiments, the pre-processed signals are generated by processing the sensor-signals 100. Referring now to FIG. 7, an embodiment of a flow diagram of a method 200 for generating pre-processed signals 210 based on sensor-signals 204 is presented. The method 200 of FIG. 7 is described with reference to the components of FIGS. 1-6. The method 200 may be performed by the controller 56 and/or the service platform 62. Additionally, one or more steps of the method 200 may be performed simultaneously or in a different sequence from the sequence in FIG. 7. The method 200 includes receiving sensor-signals 204 from sensors 70 disposed on the inner surface 104 of the compressor casing 25 of the compressor 24 (block 202). Reference numeral 204 is representative of sensor-signals such as the sensor-signals 100 that are representative of parameters in the compressor 24. It may be noted that in certain embodiments, the method 200 may be repeated for each blade of the sets of blades 80 in the compressor and/or for each sensor 70 disposed within the compressor. Moreover, in some embodiments, the sensor-signals 204 may be time series signals. By way of a non-limiting example, the sensor-signals 204 may be characterized by a high frequency, such as about 10 kHz, 100 kHz, 250 kHz, or 500 kHz, depending on the sensors 70.

The method 200 also optionally includes detrending and resampling the sensor-signals 100 to generate resampled signals (block 206). In certain embodiments, detrending the sensor-signals 100 includes removing a trend from the time-series data. For example, a trend, such as an average value (e.g., mean), a best-fitting line, or the like of the sensor-signals 100 may be subtracted from the sensor-signals 100. In this way, the sensor-signals 100 may include less points and be analyzed more efficiently. Additionally, during resampling (e.g. decimation), the sensor-signals 100 may be down-sampled to a reduced sample rate, such as 5 kHz. The sensor-signals 100 accordingly may include a greatly reduced quantity of samples, thus increasing the speed at which the embodiments disclosed herein may be performed. In certain embodiments, the method 200 may include generating pre-processed signals 21 (block 208) based on the resampled signals and/or the sensor-signals 204.

Figure 8:
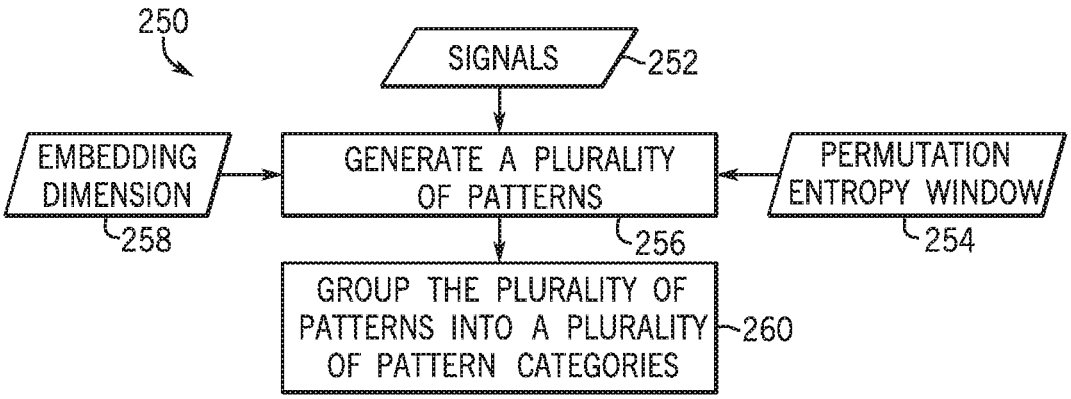
FIG. 8 is a flow diagram of an embodiment of a method for identifying a plurality of pattern categories in patterns utilized to predict an anomaly.

As previously noted with reference to block 156 of FIG. 4, a plurality of pattern categories may be identified in the patterns based on a permutation entropy window. Turning now to FIG. 8, a flow diagram of a method 250 for identifying a plurality of pattern categories in patterns, is presented. The method 250 may be described with reference to the components of FIGS. 1-7. The method 250 may be performed by the controller 56 and/or the service platform 62. Additionally, one or more steps of the method 250 may be performed simultaneously or in a different sequence from the sequence in FIG. 8. Reference numeral 252 is representative of signals. The signals 252, may be, for example, sensor-signals or pre-processed signals. For example the signals 252, may be the sensor-signals 100, 204 (see FIG. 1 and FIG. 7) or the pre-processed signals 210 (see FIG. 7). The method 250 includes generating a plurality of patterns based on a permutation entropy window 254 and the signals 252 (block 256). The permutation entropy window 254 may be characterized, for example, by an embedding dimension 258 (e.g., "D"). The embedding dimension 258, for example, may define (e.g., include) a determined number of time stamps or a determined number of samples that are considered at a given instance for pattern matching. For example, if there are "D" samples considered for pattern matching, there may be "D"! possible pattern categories for the patterns to be placed into. Accordingly, the embedding dimension 258 may ideally be defined such that "D"! is less than or equal to the total number of samples in the window, such that there are more samples than pattern categories in the window. By way of a non-limiting example, if 500 number of samples are considered at a given instance for pattern matching, "D" may be selected as 3, 4, or 5 (e.g., because 5! equals 120, which is less than 500, but 6! equals 720, which is greater than 500).

The method 250 also includes grouping the plurality of patterns into a respective plurality of pattern categories (block 260). In certain embodiments, the patterns may not be grouped into the pattern categories until a number of samples collected is greater than or equal to a number of samples in the window. For example, after the startup of the gas turbine system 10, the controller 56 and/or the service platform 62 may wait until a buffer number of samples are collected before initiating the pattern recognition algorithm and/or the method 150 of FIG. 4. Generation of the patterns and identification of the pattern categories will be described in greater detail with reference to FIG. 9 and FIG. 10.

Figure 9:
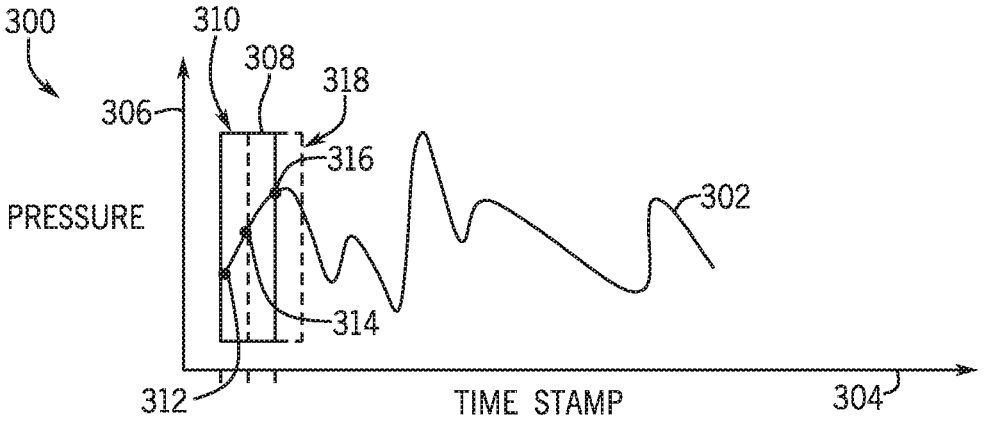
FIG. 9 depicts an embodiment of a portion of a signal representative of parameters in the compressor of FIG. 1.
Figure 10:
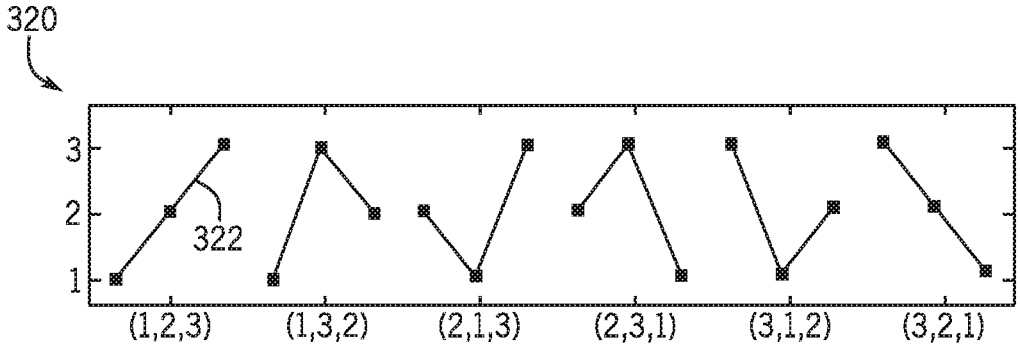
FIG. 10 depicts embodiments of various potential pattern categories identified in the signal of FIG. 9.

FIG. 9 depicts a graphical representation 300 of an example of a portion of a signal 302 representative of parameters in a compressor. Also, FIG. 10 depicts examples 320 of various potential pattern categories. It may be noted that these pattern categories may be generated via use of a permutation entropy window 308 characterized by an embedding dimension of three time stamps. The permutation window 308 may be used for generating patterns and identifying pattern categories. FIG. 9 and FIG. 10 are described in terms of the components of FIGS. 1-8.

In the example of FIG. 9, the signal 302 is shown for purposes of illustration. Other signals representative of parameters in compressors may also be used. In FIG. 9, the signal 302 is representative of pressure in the compressor 24.

Reference numeral 304 (X-axis) is representative of a time stamp. Also, reference numeral 306 (Y-axis) is representative of the pressure in the compressor 24. Moreover, a permutation entropy window is represented by reference numeral 308. As previously noted, the term "permutation entropy window" is used to refer to a virtual window that is characterized by an embedding dimension and is used to select a subset of data from a signal such that the subset of the data is characterized by the embedding dimension. In the presently contemplated configuration, the permutation entropy window 308 is characterized by a length equal to an embedding dimension "D" of three time stamps. Accordingly, there are "D"!, or six possible patterns that may be generated with the three time stamps.

When the permutation entropy window 308 is placed at a first position 310 on the signal 302, three data points 312, 314, 316 in a portion of the signal 302 that overlaps the permutation entropy window 308 are selected to form a first pattern 322 as shown in FIG. 10. Thereafter, the permutation entropy window 308 may be shifted to a subsequent position 318. Three data points in a portion of the signal 302 that overlaps with the permutation entropy window 308 positioned at the subsequent position 318 may be selected to form a second pattern. In accordance with aspects of the present specification, the permutation entropy window 308 may be shifted along the signal 302 until each data point of the signal 302 forms a part of at least one pattern. Accordingly, multiple patterns may be generated by sliding the permutation entropy window 308 across the signal 302 as depicted in FIG. 10. Additionally, as described above, the patterns may not be generated until a buffer number of points is collected (e.g., after startup of the gas turbine system 10)

Furthermore, the patterns may be grouped into pattern categories based on amplitudes of data points in the patterns. In the example of the first pattern 322 depicted in FIG. 10, an amplitude of the second data point 314 is greater than an amplitude of the first data point 312 and an amplitude of the third data point 316 is greater than an amplitude of the second data point 314. Hence, the first pattern 322 may be grouped into a pattern category (1, 2, 3). It may be noted that a pattern category may include one or more patterns where amplitudes of data points of all the patterns corresponding to that pattern category follow the same trend. For example, the pattern category (1, 2, 3) may include one or more patterns where amplitudes of second data points are greater than amplitudes of the respective first data points and amplitudes of third data points are greater than amplitudes of the respective second data points.

Figure 11:
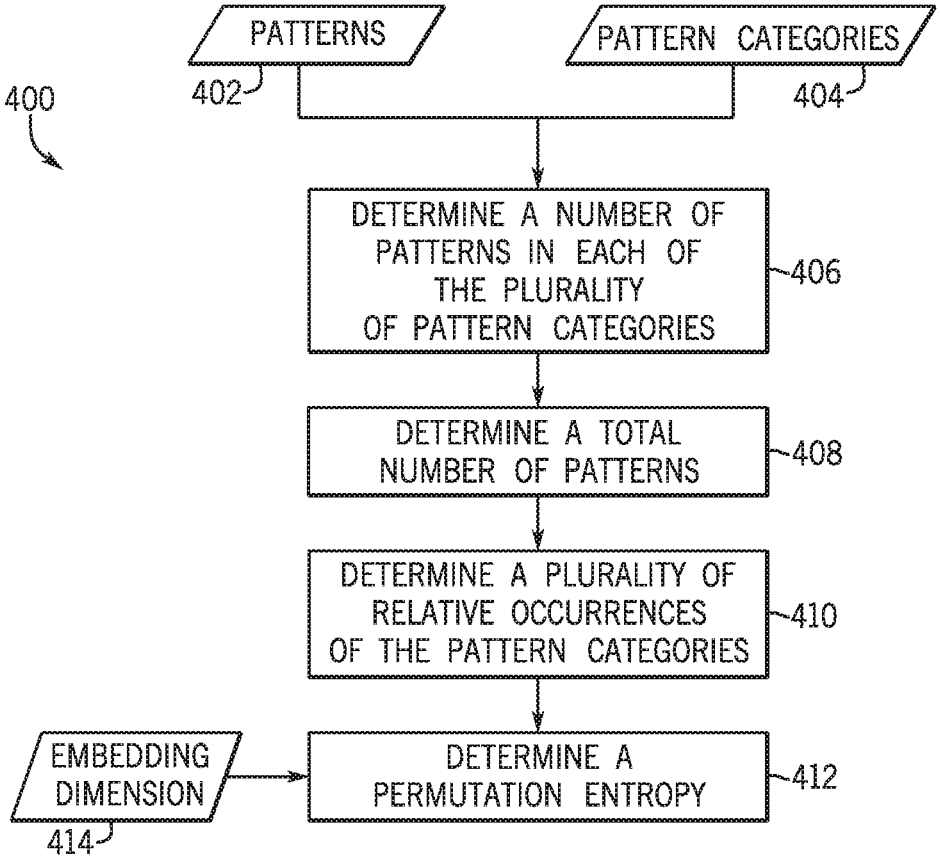
FIG. 11 is a flow diagram of an embodiment of a method for determining a permutation entropy utilized to predict an anomaly.

FIG. 11 is a flow diagram of a method 400 for determining a permutation entropy. The method 400 may be described with reference to the elements of FIGS. 1-10. The method 400 may be performed by the controller 56 and/or the service platform 62. Additionally, one or more steps of the method 400 may be performed simultaneously or in a different sequence from the sequence in FIG. 11. Reference numeral 402 is representative of patterns generated using a permutation entropy window and signals representative of parameters of one or more stages 82 of the compressor 24. For example, the patterns may be the patterns generated at block 256 in FIG. 8. In one embodiment, the patterns 402 may correspond to a set of blades in the compressor. In another embodiment, the patterns may correspond to multiple sets of blades in the compressor and/or individual blades of the set of blades.

Furthermore, reference numeral 404 is representative of pattern categories identified from the patterns 402. The pattern categories 404, for example, may be the pattern categories identified at block 260. In one embodiment, the pattern categories 404 may correspond to a single set of blades in the compressor. In another embodiment, the pattern categories may correspond to multiple sets of blades in the compressor and/or individual blades of the set of blades.

In certain embodiments, the method 400 includes determining a number of patterns in each of the pattern categories 404 (block 406). For example, the method 400 may determine that there are 20 patterns in the (1, 2, 3) pattern category, 25 patterns in the (1, 3, 2) pattern category, and 40 patterns in the (2, 3, 1) pattern category.

The method 400 also includes determining a total number of the patterns 402 (block 408). In one embodiment, if the patterns 402 correspond to multiple sets of blades in the compressor, then the total number of the patterns 402 includes patterns across multiple sets of blades in the compressor. In another embodiment, when the patterns 402 correspond to a single set of blades in the compressor, then the total number of the patterns 402 includes patterns corresponding to the single set of blades and/or individual blades of the set of blades.

The method 400 further includes determining a plurality of relative occurrences of the pattern categories (block 410). By way of a non-limiting example, the relative occurrences of the pattern categories may be determined based on the number of patterns in each of the pattern categories and the total number of patterns. Particularly, a relative occurrence corresponding to a pattern category may be determined based on a number of patterns in the pattern category and the total number of patterns. For example, a relative occurrence corresponding to a pattern category (1, 2, 3) may be determined based on a number of the pattern category (1, 2, 3) and the total number of patterns.

The method 400 also further includes determine a permutation entropy based on the relative occurrences of the pattern categories and an embedding dimension 414 of a permutation entropy window used for generating the patterns 402 (block 412). The permutation entropy, for example, may be determined using a Shannon entropy method, a Renyi permutation entropy method, a permutation mini-entropy method, and the like. The permutation entropy may estimate a degree of randomness or complexity in the sensor signals 100 and/or the pre-processed signals 106. In one embodiment, the permutation entropy may be determined via the Shannon entropy method using equation (1):

$$h_p = \frac{\sum_{\pi} p(\pi)\log_2 p(\pi)}{\log_2 D!} \quad (1)$$

where $h_p$ is representative of a permutation entropy, $p(\pi)$ is representative of a relative occurrence of a pattern category and D is representative of an embedding dimension. In another embodiment, the permutation entropy may be determined via the Renyi permutation entropy method using equation (2):

$$h_p(q) = \frac{\log_2\left(\sum_{\pi} p(\pi)^q\right)}{(1-q)\log_2 D!} \quad (2)$$

where $h_p(q)$ is representative of a permutation entropy, $p(\pi)$ is representative of a relative occurrence of a pattern category, q is representative of entropy order, and D is representative of an embedding dimension.

In still another embodiment, the permutation entropy may be determined via the permutation mini-entropy method using equation (3):

$$h_p(\infty) = \frac{-\log(\max p(\pi))}{\log_2 D!} \quad (3)$$

where $h_p(\infty)$ is representative of a permutation entropy, $p(\pi)$ is representative of a relative occurrence of a pattern category, and D is representative of an embedding dimension.

Figure 12:
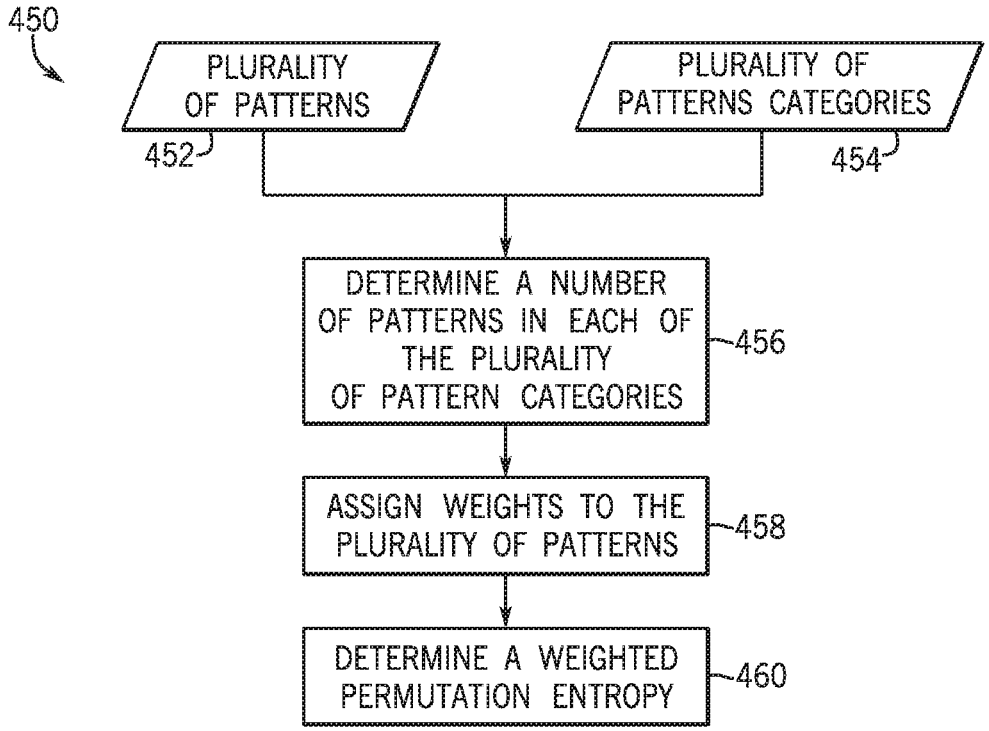
FIG. 12 is a flow diagram of an embodiment of a method for determining a weighted permutation entropy utilized to predict an anomaly.

FIG. 12 is a flow diagram of a method 450 for determining a weighted permutation entropy. The method 450 may be described with reference to the elements of FIGS. 1-11. The method 450 may be performed by the controller 56 and/or the service platform 62. Additionally, one or more steps of the method 450 may be performed simultaneously or in a different sequence from the sequence in FIG. 12.

Reference numeral 452 is representative of patterns generated using a permutation entropy window and signals representative of parameters of one or more sets of blades in the compressor. For example, the patterns may be the patterns generated at block 256 of FIG. 8. In one embodiment, the patterns 402 may correspond to a single set of blades in the compressor. In another embodiment, the patterns may correspond to multiple sets of blades in the compressor.

Furthermore, reference numeral 454 is representative of pattern categories identified from the patterns 452. The pattern categories 454, for example, may be the pattern categories identified at block 260. In one embodiment, the pattern categories 454 may correspond to a single set of blades in the compressor. In another embodiment, the pattern categories may correspond to multiple sets of blades in the compressor.

The method 450 includes determining a number of patterns in each of the pattern categories 454 (block 456). For example, if the pattern categories 454 include pattern categories such as (1, 2, 3), (1, 3, 2) and (2, 3, 1), then a number of patterns in each of the pattern categories (1, 2, 3), (1, 3, 2) and (2, 3, 1) may be determined. For example, similar to the method 400, the method 450 may determine that there are 20 patterns in the (1, 2, 3) pattern category, 25 patterns in the (1, 3, 2) pattern category, and 40 patterns in the (2, 3, 1) pattern category.

The method 450 further includes assigning weights to the patterns 452 based on amplitudes of signals used for generating the patterns 452 and the pattern categories (block 458). An example of assignment of weights to the patterns 452 will be described in greater detail with reference to FIG. 13.

The method 450 additionally includes determining the weighted permutation entropy based on the number of patterns in each of the pattern categories 454 and the weights assigned to the patterns 452 (block 460). For example, the weighted permutation entropy may be determined using the equations (1) to (3) wherein the $p(\pi)$ is a function of the weights assigned to the patterns 452.

Figure 13:
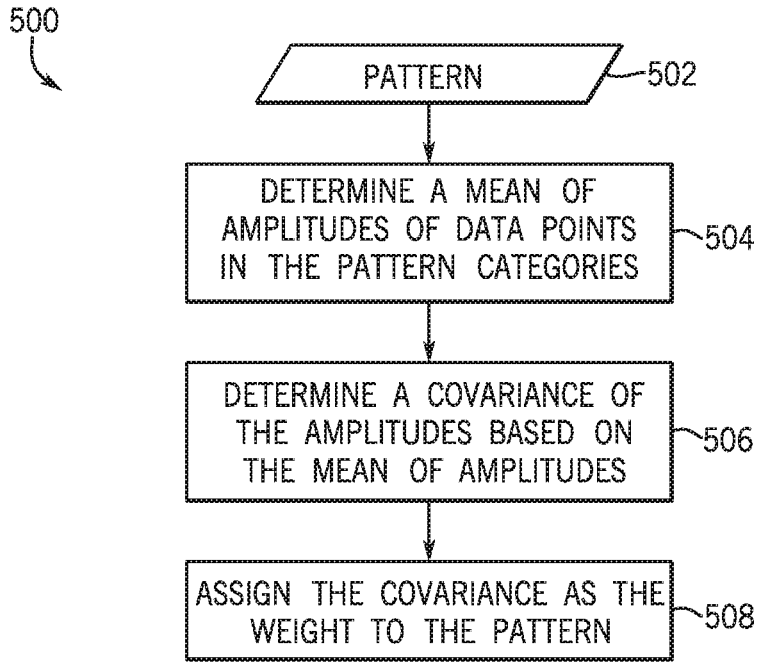
FIG. 13 is a flow diagram of an embodiment of a method for assigning weights to a plurality of patterns utilized to predict an anomaly.

FIG. 13 is a flow diagram of a method 500 for assigning a weight to a plurality of patterns. The method 500 may be described with reference to the elements of FIGS. 1-12. The method 500 may be performed by the controller 56 and/or the service platform 62. Additionally, one or more steps of the method 500 may be performed simultaneously or in a different sequence from the sequence in FIG. 13. Reference numeral 502 is representative of a pattern. The pattern 502, for example, may be one of the patterns 320, 402, 452 of FIGS. 10, 11, and 12 respectively. The method 500 includes determining a mean of amplitudes of data points in the pattern 502 (block 504). For example, if the pattern 502 is the pattern 320, then the pattern 502 includes data points 312, 314, 316 as shown in FIG. 9. Accordingly, the method 500 may determine the mean of the amplitudes of the data points 312, 314, 316. The method 500 also includes determining a covariance of the amplitudes of the data points based on the mean of the amplitudes of the data points (block 506). The method 500 additionally includes assigning the covariance as a weight to the pattern 502 (block 508).

Technical effects of the subject matter include systems and methods for predicting an anomaly in the compressor 24 of the gas turbine system 10 and performing corrective actions to minimize or avoid the predicted anomaly. The embodiments include utilizing pressure sensors 70 that generate sensor-signals 100 representative of pressure between respective compressor blade tips and the compressor casing 25 of the compressor 24, then transmitting the sensor-signals 100 to the service platform 62. In particular, the service platform 62 generates a plurality of patterns and pattern categories based on the sensor-signals 100 and/or the pre-processed signals 106. The embodiments further include determining the permutation entropy for the high speed time-series data to quickly predict the anomaly. The measure of the anomaly is then calculated based on a threshold determined from operating conditions of the gas turbine system, a probability distribution of the permutation entropy, historical permutation entropy data, or the like. Accordingly, control actions may be taken to minimize or avoid the predicted anomaly of the compressor. The disclosed embodiments may accordingly minimize or avoid anomalies of the compressor, thus increasing a lifetime and increasing an efficiency of the compressor 24 and its corresponding gas turbine system 10.

This written description uses examples to disclose the subject matter, including the best mode, and also to enable any person skilled in the art to practice the subject matter, including making and using any devices or systems and performing any incorporated methods. The patentable scope of the subject matter is defined by the claims, and may include other examples that occur to those skilled in the art.

Such other examples are intended to be within the scope of the claims if they have structural elements that do not differ from the literal language of the claims, or if they include equivalent structural elements with insubstantial differences from the literal language of the claims.

The invention claimed is:

1. A non-transitory computer-readable storage medium storing one or more processor-executable instructions, wherein the one or more instructions, when executed by a processor of a controller, cause acts to be performed comprising:

receiving one or more signals representative of pressure between respective compressor blade tips and a casing of a compressor at one or more stages;

generating a plurality of patterns based on a permutation entropy window and the signals;

identifying a plurality of pattern categories in the plurality of patterns;

determining a permutation entropy based on the plurality of patterns and the plurality of pattern categories;

predicting an anomaly in the compressor based on the permutation entropy;

comparing the plurality of pattern categories to determined permutations of pattern categories when an anomaly is present in the compressor; and predicting an anomaly category of the anomaly from a plurality of different anomaly categories based on the comparison of the plurality of pattern categories to the determined permutation of pattern categories.

2. The non-transitory computer-readable storage medium of claim 1, wherein identifying the plurality of pattern categories comprises grouping the plurality of patterns into the plurality of pattern categories based on amplitudes of data points corresponding to the plurality of patterns.

3. The non-transitory computer-readable storage medium of claim 1, wherein determining the permutation entropy comprises:

determining a number of patterns in each of the plurality of pattern categories;

determining a plurality of relative occurrences of the plurality of pattern categories based on the number of patterns in each of the plurality of pattern categories and a total number of the plurality of patterns; and determining the permutation entropy based on the plurality of relative occurrences of the plurality of pattern categories and an embedding dimension of the permutation entropy window.

4. The non-transitory computer-readable storage medium of claim 3, wherein the permutation entropy comprises a weighted permutation entropy, wherein determining the permutation entropy comprises determining the weighted permutation entropy, and wherein the determining the weighted permutation entropy comprises:

assigning weights to the plurality of patterns based on a plurality of amplitude signals; and determining the weighted permutation entropy based on the number of patterns in each of the plurality of pattern categories and the corresponding weights of the plurality of patterns.

5. The non-transitory computer-readable storage medium of claim 4, wherein assigning the weights to the plurality of patterns comprises:

determining a mean of amplitudes of data points corresponding to the plurality of patterns;

determining a covariance of the amplitudes of the data points based on the mean of amplitudes; and assigning the covariance as the weight to the plurality of patterns.

6. The non-transitory computer-readable storage medium of claim 1, wherein different anomaly categories of the plurality of different anomaly categories comprise a stall, a surge, and an instability in the compressor, and wherein the anomaly category of the anomaly in the compressor comprises the stall, the surge, the instability in the compressor, or a combination thereof.

7. The non-transitory computer-readable storage medium of claim 1, wherein the acts to be performed comprise generating pre-processed signals, wherein generating the pre-processed signals comprises:

receiving pressure sensor-signals from one or more sensors; and generating resampled signals by resampling and de-trending the sensor-signals.

8. The non-transitory computer-readable storage medium of claim 7, wherein receiving the one or more signals representative of the pressure between respective compressor blade tips and the casing of the compressor comprises receiving the sensor-signals from the one or more sensors, receiving the pre-processed signals, or a combination thereof.

9. The non-transitory computer-readable storage medium of claim 1, wherein predicting the anomaly comprises comparing the permutation entropy to a determined threshold.

10. The non-transitory computer-readable storage medium of claim 9, wherein the determined threshold is a function of operating conditions of a gas turbine comprising the compressor.

11. The non-transitory computer-readable storage medium of claim 9, wherein the determined threshold is derived from a probability distribution of the permutation entropy.

12. The non-transitory computer-readable storage medium of claim 9, wherein the determined threshold is derived from historical permutation entropy data.

13. The non-transitory computer-readable storage medium of claim 1, wherein the acts to be performed comprise, in response to the predicted anomaly, causing a corrective action to a gas turbine comprising the compressor to occur to minimize or avoid the predicted anomaly.

14. A system for predicting an anomaly in a compressor, comprising:

one or more sensors disposed on a casing of the compressor adjacent respective compressor blade tips at one or more stages, wherein the one or more sensors are configured to generate sensor-signals representative of pressure between respective compressor blade tips and the casing of the compressor at the one or more stages; and a controller operatively coupled to the one or more sensors and programmed to:

pre-process the sensor-signals to generate pre-processed signals;

generate a plurality of patterns based on a permutation entropy window and the pre-processed signals;

identify a plurality of pattern categories in the plurality of patterns;

determine a permutation entropy based on the plurality of patterns and the plurality of pattern categories;

predict an anomaly in the compressor based on the permutation entropy;

compare the plurality of pattern categories to determined permutations of pattern categories when an anomaly is present in the compressor; and predict an anomaly category of the anomaly from a plurality of different anomaly categories based on the comparison of the plurality of pattern categories to the determined permutation of pattern categories.

15. The system of claim 14, wherein the controller is programmed to group the plurality of patterns into the plurality of pattern categories based on amplitudes of data points corresponding to the plurality of patterns to identify the plurality of pattern categories.

16. The system of claim 14, wherein the controller is programmed to:

determine a number of patterns in each of the plurality of pattern categories;

determine a plurality of relative occurrences of the plurality of pattern categories based on the number of patterns in each of the plurality of pattern categories and a total number of the plurality of patterns; and determine the permutation entropy based on the plurality of relative occurrences of the plurality of pattern categories and an embedding dimension of the permutation entropy window.

17. The system of claim 14, wherein the permutation entropy comprises a weighted permutation entropy, and wherein the controller is programmed to:

assign weights to the plurality of patterns based on a plurality of amplitude signals; and determine the weighted permutation entropy based on the number of patterns in each of the plurality of pattern categories and the corresponding weights of the plurality of patterns.

18. The system of claim 17, wherein the controller is programmed to:

determine a mean of amplitudes of data points corresponding to the plurality of patterns;

determine a covariance of the amplitudes of the data points based on the mean of amplitudes; and assign the covariance as the weight to the plurality of patterns.

19. The system of claim 14, wherein the one or more sensors comprise an acoustic sensor, a pressure sensor, a vibration sensor, a piezoelectric sensor, or a combination thereof.

20. A system, comprising:

a gas turbine comprising a compressor, wherein the compressor comprises a plurality of stages, each stage having a plurality of compressor blades;

one or more sensors disposed on a casing of the compressor adjacent respective compressor blade tips at one or more stages of the plurality of stages, wherein the one or more sensors are configured to generate sensor-signals representative of pressure between respective compressor blade tips and the casing of the compressor at the one or more stages; and a controller operatively coupled to the one or more sensors and programmed to:

pre-process the sensor-signals to generate pre-processed signals;

generate a plurality of patterns based on a permutation entropy window and the pre-processed signals;

identify a plurality of pattern categories in the plurality of patterns;

determine a permutation entropy based on the plurality of patterns and the plurality of pattern categories;

predict an anomaly in the compressor based on the permutation entropy;

compare the plurality of pattern categories to determined permutations of pattern categories when an anomaly is present in the compressor; and predict an anomaly category of the anomaly from a plurality of different anomaly categories based on the comparison of the plurality of pattern categories to the determined permutation of pattern categories.

* * * * *